US005090566A

United States Patent [19]

Yount

[11] Patent Number: 5,090,566

[45] Date of Patent: Feb. 25, 1992

[54] PAPER ROLL HEADER AND PAPER ROLL WRAPPER ASSEMBLY

[75] Inventor: George S. Yount, San Marino, Calif.

[73] Assignee: Fortifiber Corporation, Los Angeles, Calif.

[21] Appl. No.: 638,096

[22] Filed: Jan. 7, 1991

[51] Int. Cl.[5] ..... B65D 85/66

[52] U.S. Cl. ..... 206/416; 206/389; 242/68.6

[58] Field of Search ..... 206/413–416, 206/389; 242/68.6

[56] References Cited

U.S. PATENT DOCUMENTS

| | | | |
|---|---|---|---|
| 2,175,045 | 10/1939 | Vogel | 206/389 |
| 2,797,804 | 7/1957 | Pomeroy et al. | 206/413 X |
| 3,066,848 | 12/1962 | Billeb . | |
| 3,523,050 | 8/1970 | Campbell . | |
| 3,942,638 | 3/1976 | Stone | 206/416 |
| 4,185,742 | 1/1980 | Fisk et al. | 206/414 |
| 4,265,954 | 5/1981 | Romanek . | |
| 4,820,374 | 4/1989 | Lamb . | |

*Primary Examiner*—Bryon P. Gehman

*Attorney, Agent, or Firm*—Price, Heneveld, Cooper DeWitt & Litton

[57] ABSTRACT

A paper roll header having a first waterproof polymeric coating over its inner face, the coating being a thermoplastic which is heat softenable at a predetermined elevated temperature for bonding to the crimped end of a wrapper around the paper roll, and a second coating on the first coating on the inner face of the roll, the second coating being in the central zone of the inner face and being non-softenable at the noted predetermined elevated temperature, so that the heat sealingly bonds to the wrapper but not to the end of the roll itself.

6 Claims, 1 Drawing Sheet

PAPER ROLL HEADER AND PAPER ROLL WRAPPER ASSEMBLY

BACKGROUND OF THE INVENTION

This invention relates to paper roll headers.

In the paper manufacturing industry, the ends of large wound rolls of paper stock are typically protected by an outer wrapping around the periphery crimped over the annular edges, plus end plates known as headers. These headers may be formed of various materials, but typically include an inner header which is not waterproof and abuts an end of the roll with the wrapper crimped thereover, and an outer header which is waterproof and is sealed to the inner header and to the crimped wrapper ends. Each outer header is coated with a thermoplastic polymer, enabling it to be heat sealed to the peripheral wrapper and inner header to prevent moisture from penetrating or escaping from the ends of the rolled paper. The assembly of these components is preferably largely accomplished by machinery. Thus, the headers can be picked off a stack by a vacuum, i.e., suction, unit. Since the inner header is porous, the vacuum head unfortunately tends to pick up more than one at a time. If no inner header is employed, the outer header tends to bond to the paper as well as the crimped wrapper. This damages the paper. A dual temperature platen, taught in U.S. Pat. No. 4,820,374 was developed for controlling the area of the header to be heated. This apparatus is not readily adaptable to heads of different size. Moreover, the cost of the apparatus is not insignificant.

SUMMARY OF THE INVENTION

An object of this invention is to provide a novel header which enables substantial savings for paper manufacturers. The novel header does not require a dual temperature heat platen for sealing the header to the crimped wrapper edge. The header is coated with a thermoplastic polymer that renders it waterproof, yet the central portion of the header does not become bonded to the rolled paper when the heated platen is pressed against the header. The header is applicable to headers of different sizes.

The novel header is formed of a plate having an inner face and an outer face, the inner face of which is coated by a thermoplastic coating rendering the plate waterproof, this coating being softenable at a predetermined elevated temperature to form a bond. A second coating covers the central zone of this thermoplastic coating on the inner face of the header, this second coating being nonsoftenable at the noted predetermined elevated temperature, causing the thermoplastic only in an outer annulus outside of this second coating to soften and bond to the crimped wrapper.

These and other objects, advantages and features of this invention will become apparent upon studying the following detailed specification in conjunction with the drawings.

DESCRIPTION OF THE PREFERRED EMBODIMENT

Figure 1:
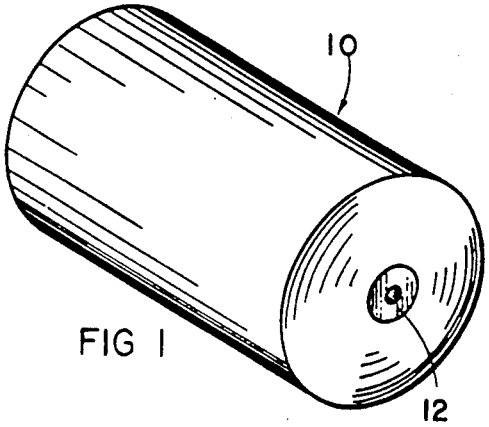
FIG. 1 is a perspective view of a cylindrical roll of paper.

Referring now to the drawings, there is depicted in FIG. 1 a conventional roll of paper stock 10, such constituting a cylindrical structure, typically a few inches up to several feet long and at least a few feet in diameter. The roll has a cylindrical periphery and a pair of ends. It is typically wound on a core 12 as depicted.

Figure 2:
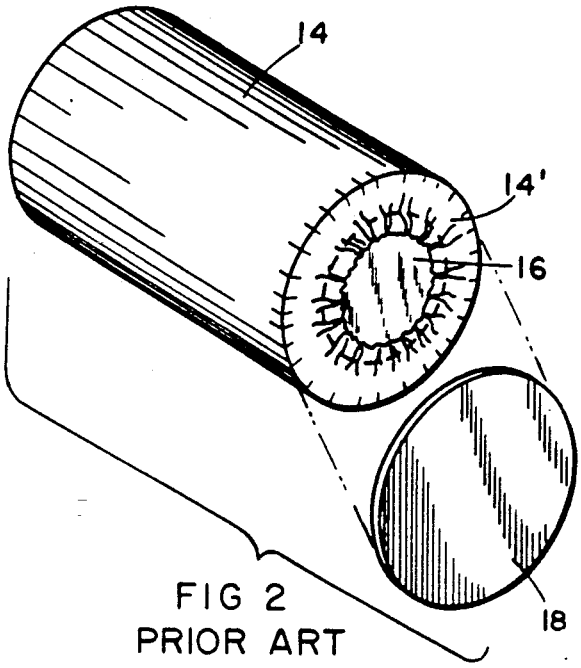
FIG 2 PRIOR ART
FIG. 2 is a perspective view of a prior art paper roll, wrapper and double header assembly.

FIG. 2 shows a conventional paper roll wrapper and double header assembly wherein the roll 10 of FIG. 1 is wrapped by a peripheral enclosing wrapper 14 which is wider than the length of the roll so that the ends of the wrapper can be crimped over the end peripheral edges to form crimped wrapper portions 14' extending over outer annular portions of the ends of the roll. Abutting each of the two ends of the roll directly in this prior art structure is an inner header 16. This inner header is typically formed of a porous stock such as paperboard or the like, and has its outer radial portions covered by the crimped portions 14' of the wrapper. The dotted line in FIG. 2 shows a typical periphery of this inner header. The assembly also includes an outer header 18 which normally is coated on at least its inner face with a waterproof polymer having a predetermined softening temperature. By pressing a heated platen against the outer face, the inner face is pressed against the crimped wrapper and heated so as to sealingly bond it to wrapper portion 14'.

Often it is desired to forego the use of an inner header. One reason is cost of added material and more assembly operations. Another reason is that, with use of a vacuum head to pick up the inner header and apply it to the roll, e.g., by robotics, the porous nature of the header causes two or more headers to be inadvertently picked up by the vacuum head to thereby cause difficulty in the operation. It would be desirable at times to be able to apply the outer header directly to the roll, without the use of an inner header, but the outer header still needs to be waterproof, i.e., polymer coated, and the outer header should not be bonded to the paper roll itself. This invention accomplishes those results without the necessity of using the special dual temperature platen in U.S. Pat. No. 4,820,374 to Lamb.

Figure 3:
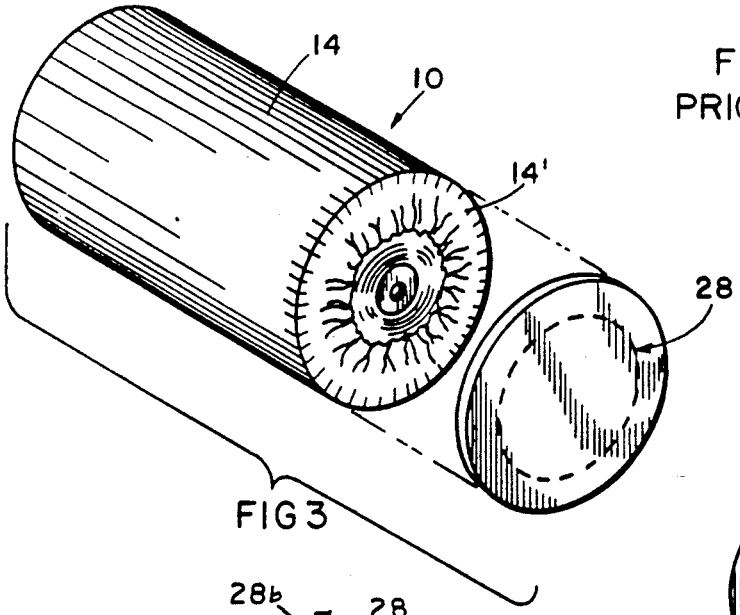
FIG. 3 is a perspective view of a roll, wrapper and header assembly of this invention.
Figure 4:
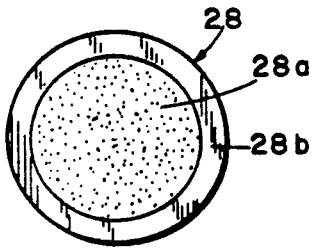
FIG. 4 is an elevational view of the inner face of the header in FIG. 3.
Figure 5:
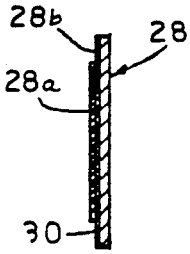
FIG. 5 is a cross sectional view of the header plate and coatings.

More specifically, referring to FIGS. 3 and 4, the paper roll 10 is there shown encompassed by its peripheral wrapper 14 which has portions 14' extending over and crimped against the outer radial portions of the paper roll, leaving uncovered the central portion as depicted. Outer header 28 is sealingly bonded directly to the crimped wrapper portions 14', but not bonded to the paper of roll 10. This outer header has inner and outer faces. At least the inner face is covered by a coating 30 of waterproof polymer, e.g., a polyolefin such as polyethylene, polypropylene, polyvinyl or other such thermoplastic polymer which has a softening point at a predetermined temperature, e.g., 280° F. for polyethylene. The polymer provides a waterproof coating and also is bondable to crimped portion 14' of wrapper 14. On the central portions of the inner face is a second coating **28*a* (FIG. 4) applied over the first coating, the first coating still being exposed around the outer annular portion 28*b* of the inner face. This central second coating extends radially out from the center of the circular header to a radius greater than the uncovered central portion of roll 10, i.e., so as to be in engagement with only the crimped portions 14' of the wrapper. The central coating is of a material which will not soften at the predetermined temperature at which the first coating softens. This coating is preferably visually discernible from the outer portion, as by employing an ink compound such as a conventional nitro cellulose ink. On a typical roll that has a diameter of, e.g., about 41 inches, approximately two to four inches of the radially outer annular portion 28*b* will be exposed, while the second coating at central zone 28*a* will cover the remainder of the inner face of the header. With this construction, a simple heat platen may be employed, pressing a header 28 against each end of the roll, softening the outer radial portions at 28*b* to sealingly bond them to the crimped wrapper portions 14'**, and seal off the paper from ambient atmosphere. Yet, no bonding occurs to the paper itself so as to lower its quality or usefulness.

The illustrated embodiment is the preferred embodiment. However, this invention is not intended to be limited except by the scope of the appended claims and the reasonably equivalent structures to those defined therein.

The embodiments of the invention in which an exclusive property or privilege is claimed are defined as follows.

1. A paper roll header comprising:

a header plate having an inner face and an outer face;

a first waterproof polymeric coating over said inner face;

said coating having thermoplastic character to be heat-softenable for bonding at a predetermined elevated temperature;

said inner face having a central zone and an outer annular zone;

a second coating covering said first waterproof polymeric coating only in said central zone, thereby leaving said first coating exposed only in said annular zone; and said second coating being nonsoftenable at said predetermined elevated temperature, whereby said header plate is sealingly atachable to a paper roll wrapper only in said annular zone by a heated platen pressed against said header plate.

2. The paper roll header in claim 1 wherein said waterproof polymeric coating is a polyolefin.

3. The paper roll header in claim 1 wherein said second coating is a heat-resistant compound which is visually distinguishable from said waterproof coating.

4. The paper roll header in claim 3 wherein said second coating is a nitro cellulose-based ink.

5. A paper roll, wrapper and header assembly comprising:

a cylindrical roll of wound paper having a periphery and a pair of ends;

a wrapper around said periphery having portions crimped over the outer annular portions of said ends while leaving the central portions uncovered by said wrapper;

a header on each end of said roll, externally of said wrapper, said header having an inner face in abutment with said crimped portions of said wrapper and having inner face central portions adjacent said central roll portions;

said header also having an outer face;

said inner face being coated with a waterproof polymer having a predetermined softening temperature;

the outer radial portion of said inner face being sealingly bonded by said polymer to said crimped portions of said wrapper; and a second coating on said central portions of said inner face, said second coating being nonsoftenable at said predetermined softening temperature, and said central portions of said inner face being adjacent said central portions of said roll uncovered by said wrapper, but not bonded thereto.

6. The assembly in claim 5 wherein said second coating is colored to cause a visual difference between said central portions, and said outer radial portion.

* * * * *